US006367640B1

(12) United States Patent
Julian

(10) Patent No.: US 6,367,640 B1
(45) Date of Patent: Apr. 9, 2002

(54) CONTAINER AND CLOSURE CAP

(75) Inventor: Randall K. Julian, Newburgh, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 09/391,788

(22) Filed: Sep. 8, 1999

(51) Int. Cl.[7] ..... B65D 41/04
(52) U.S. Cl. ..... 215/329; 215/44; 215/334
(58) Field of Search ..... 215/329, 334, 215/44, 45; 220/288, 289

(56) References Cited

U.S. PATENT DOCUMENTS

| | | | | | |
|---|---|---|---|---|---|
| 3,589,550 | A | * | 6/1971 | Rossmann | 220/288 |
| 3,640,416 | A | * | 2/1972 | Temple | 215/329 |
| 3,841,514 | A | | 10/1974 | Montgomery et al. | |
| 3,877,597 | A | | 4/1975 | Montgomery et al. | |
| 3,904,063 | A | * | 9/1975 | Hauser | 215/318 |
| 4,190,171 | A | * | 2/1980 | Kulle et al. | 215/329 |
| 4,231,480 | A | * | 11/1980 | Spransy | 215/329 |
| 4,423,821 | A | * | 1/1984 | McIntosh | 215/329 |
| 4,526,284 | A | * | 7/1985 | Herbert | 215/329 |
| 4,591,063 | A | * | 5/1986 | Geiger | 215/330 |
| 4,623,070 | A | * | 11/1986 | Nishikawa | 215/329 |
| 4,069,937 | A | | 1/1989 | Smalley | |
| 4,844,250 | A | * | 7/1989 | Holoubek et al. | 222/107 |
| 5,020,683 | A | * | 6/1991 | Stassheimer | 215/354 |
| 5,722,545 | A | * | 3/1998 | Rinne | 215/44 |
| 5,871,111 | A | * | 2/1999 | Pfefferkorn et al. | 215/307 |
| 6,059,134 | A | * | 5/2000 | Long, Jr. | 215/252 |
| 6,105,801 | A | * | 8/2000 | Minnette | 215/45 |

FOREIGN PATENT DOCUMENTS

| | | | | |
|---|---|---|---|---|
| EP | 0787660 A1 | | 6/1997 | |
| GB | 2011869 B | | 11/1982 | |
| GB | 2105693 B | | 3/1983 | |
| GB | 2251240 A | | 1/1992 | |
| JP | 406247455 | * | 9/1994 | 215/329 |

* cited by examiner

*Primary Examiner*—Lee Young
*Assistant Examiner*—Joseph C. Merek
(74) *Attorney, Agent, or Firm*—John F. Salazar; Middleton Reutlinger

(57) ABSTRACT

A container (1) having an open-ended and externally screw threaded cylindrical neck (4) is fitted with a closure cap (2) having an internal screw thread (10) adapted to cooperate with the thread (7) on the container neck and a planar end wall (8) adapted to form a seal with the open end (6) of the container neck. At least one of the opposing surfaces of the screw threads on the cap and the container neck is sufficiently inclined to the plane perpendicular to the axis of the neck of the container at an angle of at least 60° so that the screw threads can slip laterally on one another to enable the side wall of the cap or the neck of the container to deform when the cap is tightened onto the container to form a seal.

16 Claims, 1 Drawing Sheet

CONTAINER AND CLOSURE CAP

BACKGROUND OF THE INVENTION

1. Field of the Invention

The invention relates to a container and closure cap therefor and in particular relates to a container and closure cap of the type in which the cap is screwed onto the container to a predetermined rotational orientation relative thereto.

2. Discussion of the Prior Art

It is frequently desired, typically for aesthetic reasons but also for some child resistant closure latch mechanisms, to design threaded closures and containers with non-round shapes or otherwise irregular protrusions intended to sit in alignment with respect to each other when the package is in the closed and sealed position. One example would be square shaped jars and caps for skin creams or other personal care products. Another includes oval shaped double wall screw caps designed to lock onto oval child resistant containers for medicines and other hazardous consumer products.

Due to minor variations in thread and sealing lip dimensions resulting from mass production tooling and processes, closure orientation may vary by as much as 20 to 100 degrees relative to the container body when screwed on and tightened to a particular sealing force. Conversely, when such closures are screwed on to an orientation stop, the sealing force may vary from zero to an unacceptably high value.

While there are many dimensions that can vary to cause the problem, the net result of any combination of variations may be measured as a variation in the vertical dimension between the inside roof of the closure and the sealing lip on the bottle when the cap is brought to a particular orientation and stopped.

In the past, closures have been designed to overcome this problem by means of a special sealing feature designed to telescope vertically with a cooperating feature on the container neck, such as tight fitting plug sized to seal the bore of the container neck over a range of depths of insertion. However, in many cases this technique will not work for lack of a smooth controlled diameter on the bottle to seal against.

In other instances closures have been designed to use a gasket resilient through an appropriate range of compressibility to take up the variation and provide sealing pressure within a suitable range. However, it is frequently desired to use only a thin film glued or heat sealed across the mouth of the container in place of a resilient gasket so as to provide tamper evidence, improved barrier properties and reduced cost.

The stop to which such closures are tightened to provide alignment with the container may be either or both of two general configurations. In the first instance, a radial stop on the neck of the container is configured to interact with a cooperating stop, either at the thread tail-out or on the skirt of the closure. In other cases, the stop is implemented as the lower extremity of the closure skirt comes into the vertical contact with a specially configured (squared off) shoulder on the container. The latter is frequently used to eliminate any unsightly gap between the skirt of the closure and the shoulder of the container. Again, in both cases, the positioning of the closure against any surface other than the sealing surface creates a variability in the pressure exerted against the sealing surface and results in either over-tightened closures, which are difficult to remove, or loose closures which are not well sealed to the container.

In U.S. Pat. No. 3,894,647 a container and closure cap are described in which the cap is screwed onto the container to a predetermined rotational orientation defined by a stop. The cap is formed with a tubular skirt connected to a disc-like top through a resilient annular shoulder portion which flexes to compensate for tolerance variations in the threads of the cap and container neck in order to ensure that the cap liner seals the neck of the container. The flexing of the annular shoulder causes an unsightly distortion and may even leave visible stress marks.

SUMMARY OF THE INVENTION

The present invention seeks to improve on the prior art and provides a container and closure cap therefor comprising: a container having an open-ended and externally screw threaded cylindrical neck; and a closure cap having a cylindrical side wall with an internal screw thread adapted to cooperate with the thread on the container neck and a planar end wall adapted to form a seal with the open end of the container neck; wherein at least one of the opposing surfaces of the screw threads on the cap and the container neck is inclined to the plane perpendicular to the axis of the neck of the container at an angle of at least 60° and both screw thread surfaces have sufficient lateral extent, that the screw threads can slip laterally on one another to enable the side wall of the cap or the neck of the container to deform when the cap is tightened onto the container to a particular predetermined rotational orientation relative thereto which is rotationally beyond the point at which the end wall of the cap forms a seal with the open end of the neck.

BRIEF DESCRIPTION OF THE DRAWINGS

Embodiments of the invention are described below with reference to the accompanying drawings in which.

DETAILED DESCRIPTION OF THE PREFFERED EMBODIMENT

Figure 1:
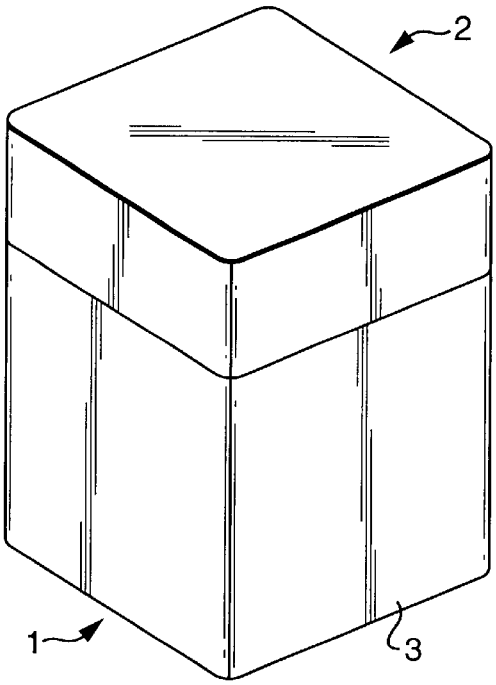
FIG. 1 is an isometric view of a container with a closure cap fitted.

A generally rectangular container 1 is shown in FIG. 1 having a generally rectangular closure cap 2. As seen from FIG. 2 the container has a body 3 and a cylindrical neck 4 connected to the body by a shoulder 5. The neck has an open end 6 and is provided with an external screw thread 7. External screw thread 7 includes an upper surface and a lower surface 13. Lower surface may be inclined relative to a plane perpendicular to the axis of the neck 4.

The cap 2 has a planar end wall 8 and a cylindrical side wall 9 which is provided with an internal screw thread 10 having an upper surface 14 and a lower surface. When cap 2 is attached to neck 4, upper surface 14 may be inclined relative to a plane perpendicular to the axis of the neck 4. The threads 7 and 10 are adapted to enable the cap to be screwed onto the container so that the end wall 8 can form a seal with the open end 6 of the neck 4. A cap liner 11 is provided to enhance this seal.

The cap is also formed with a skirt 12 which has a rectangular cross section corresponding to that of the container 1 and surrounds the cylindrical side wall.

The opposing surfaces 13 and 14 of the screw threads are both inclined at an angle α to the plane parallel perpendicular to the axis of the neck 4 of the container. The angle of inclination is preferably at lease 60°–75° in the case of a container and cap made of thermoplastic materials, the most preferred angle is 65°. In the case of a container and cap made of metals, the angle of inclination is preferably about 70°–80°.

Figure 2:
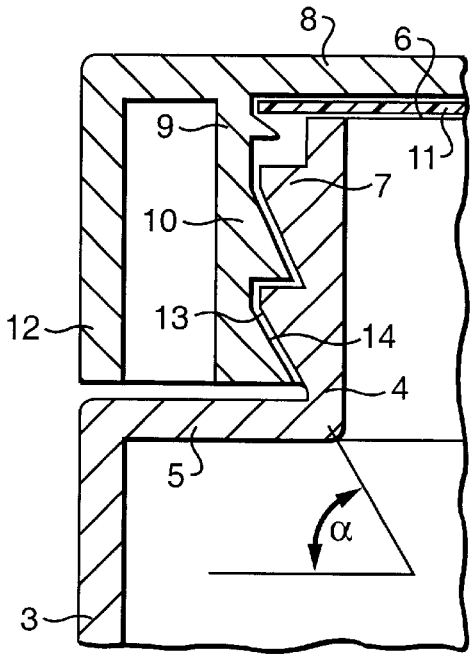
FIG. 2 is a partial cross sectional view taken on the line II—II in FIG. 1 with the cap loosely applied to the container.
Figure 3:
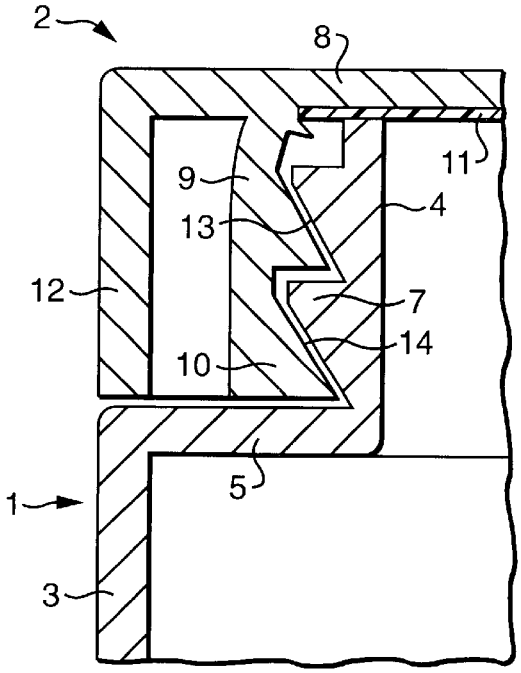
FIG. 3 is a view similar to that of FIG. 2 but with the cap tightly applied to the container.

When the cap is tightened onto the container to a predetermined rotational orientation defined by the aligned position shown in FIG. 1, it passes through the loose position shown in FIG. 2 to the tight position shown in FIG. 3. Here it can be seen that the aligned position has been achieved after an initial seal has been made between the end wall 8 of the cap and the open end 6 of the container and further tightening of the cap to the aligned position has caused the screw threads 7 and 10 to slip laterally on one another causing the cylindrical side wall to deform by bulging outwardly. The degree of slipping and consequent bulging will vary according to manufacturing tolerances. It will be appreciated that the screw thread surfaces must have sufficient lateral extend that they can slip laterally on one another without becoming disengaged and jumping over one another.

Figure 4:
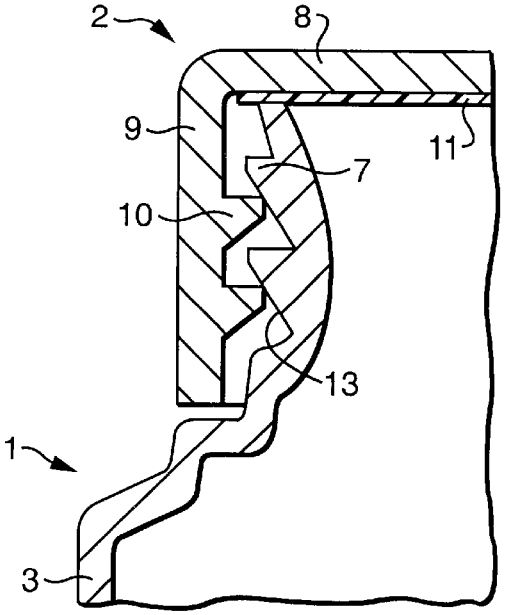
FIG. 4 is a view corresponding to that of FIG. 3 but showing an alternative container and cap.

In a modified embodiment shown in the tightened condition in FIG. 4, only the surface 13 of the screw thread on the container neck is inclined. In this embodiment it is the neck of the container which is adapted to bulge inwardly when the opposing surfaces of the threads 7 and 10 slip laterally on one another. The outer skirt is omitted in this embodiment since the container is cylindrical rather than generally rectangular.

The foregoing detailed description is given primarily for clearness of understanding and no unnecessary limitations are to be understood therefrom for modifications will become obvious to those skilled in the art upon reading this disclosure and may be made without departing from the spirit of the invention of the scope of the appended claims.

What is claimed is:

1. A container and closure cap, comprising:

a container having a neck, said neck including an open end and an external screw thread;

a closure cap having a planar end wall and a downwardly extending cylindrical side wall with an internal screw thread extending inwardly and downwardly therefrom, said internal screw thread having at least one upper surface opposing at least one lower surface of said external screw thread; and, at least one of said upper surface of said internal screw thread and said opposing lower surface of said external screw tread being inclined at an angle, said angle being at least 60° relative to a plane perpendicular to the longitudinal of said neck of said container.

2. The container and closure cap of claim 1, said upper surface of said internal screw thread and said lower surface of external screw thread having sufficient lateral extent such that said upper surface of said internal screw thread and said lower surface of said external screw thread slip laterally on each other to enable said side wall of said cap to deform when said cap is tightened onto said container to a particular predetermined rotational orientation relative thereto which is rotationally beyond a point at which said planar end wall of said cap forms a seal with said open end of said neck.

3. The container and closure cap of claim 1, wherein said angle is about 60° to 75°.

4. The container and closure cap of claim 1, wherein said upper surface of said internal screw thread and said lower surface of external screw thread are parallel to one another and said angle is about 65°.

5. The container and closure cap of claim 1, said cap including a skirt surrounding said cylindrical side wall.

6. The container and closure cap of claim 1, said cylindrical side wall of said cap bulging outwardly when said upper surface of said internal screw thread and said lower surface of external screw thread slip laterally on each other.

7. The container and closure cap of claim 1, said neck bulging inwardly when said upper surface of said internal screw thread and said lower surface of external screw thread slip laterally on each other.

8. The container and closure cap of claim 1, said upper surface of said internal screw thread and said lower surface of said external screw thread having sufficient lateral extent such that said upper surface of said internal screw thread and said lower surface of external screw thread slip laterally on each other to enable said neck of said container to deform when said cap is tightened onto said container to a particular predetermined rotational orientation relative thereto which is rotationally beyond a point at which said planar end wall of said cap forms a seal with said open end of said neck.

9. A container and closure cap, comprising:

a container having a neck, said neck having an open end and an external screw thread, said external screw thread having a lateral upper surface and an upwardly angled lower surface;

a closure cap attached to said container, said closure cap having a planar end wall with a cylindrical side wall downwardly extending therefrom, said cylindrical side wall having an inwardly and downwardly extending internal screw thread with an angled upper surface and a lateral lower surface; and, at least one of said lower surface of said external screw thread and said upper surface of said internal screw thread being opposed and inclined at an angle, said angle being at least 60° relative to a plane perpendicular to the longitudinal axis of said neck of said container.

10. The container and closure cap of claim 9, said lower surface of said external screw thread being inclined at an angle of between about 60° and 75° relative to said plane.

11. The container and closure of claim 9, said upper surface of said internal screw thread being inclined at an angle of between about 60° and 75° relative to said plane.

12. The container and closure of claim 9, said cylindrical side wall being deformed outwardly when said container and said closure cap are in a predetermined rotational orientation.

13. The container and closure cap of claim 9, said neck being inwardly bulged when said upper surface of said internal screw thread and said lower surface of said external screw thread are laterally slipped over on each other.

14. The container and closure cap of claim 9, said closure cap including a skirt having a rectangular cross section enclosing said cylindrical side wall.

15. The container and closure cap of claim 9, said container being made of a metal and said closure cap also being made of a metal, said angle being between about 70° and 80°.

16. A container and closure cap, comprising:

a container having a neck, said neck including an open end and an external screw thread with an upwardly angled external screw thread surface;

a cap attached to said container, said cap including a cylindrical side wall having an internal screw thread with an inwardly and downwardly extending internal screw thread surface, said internal screw thread surface cooperating with said external screw thread surface; and, said external screw thread surface cooperating and opposing said surface of said internal screw thread, said surface of said external screw thread inclined at an angle, said angle being at about 60° to about 75° relative to a plane perpendicular to the longitudinal of said neck, said internal screw thread further having a lateral lower surface cooperating with a lateral upper surface of said external screw thread.

* * * * *

UNITED STATES PATENT AND TRADEMARK OFFICE

CERTIFICATE OF CORRECTION

PATENT NO. : 6,367,640 B1
DATED : April 9, 2002
INVENTOR(S) : Julian, Randall K.

It is certified that error appears in the above-identified patent and that said Letters Patent is hereby corrected as shown below:

Column 2,
Line 54, after the second "surface" insert -- 13 --;

Column 3,
Line 51, change "tread" to -- thread --;
Line 53, after "longitudinal" insert -- axis --;

Column 6,
Line 2, after "longitudinal" insert -- axis --.

Signed and Sealed this

Fourth Day of February, 2003

JAMES E. ROGAN
*Director of the United States Patent and Trademark Office*